US010948244B2

(12) United States Patent
Moscatelli et al.

(10) Patent No.: US 10,948,244 B2
(45) Date of Patent: Mar. 16, 2021

(54) FIN FOR A FINNED PACK FOR HEAT EXCHANGERS, AS WELL AS HEAT EXCHANGER

(71) Applicant: STEFANI S.p.A., Vicenza (IT)

(72) Inventors: Enrico Moscatelli, Brescia (IT); Andrea Stefani, Vicenza (IT)

(73) Assignee: STEFANI S.P.A., Vicenza (IT)

( * ) Notice: Subject to any disclaimer, the term of this patent is extended or adjusted under 35 U.S.C. 154(b) by 197 days.

(21) Appl. No.: 15/526,198

(22) PCT Filed: Nov. 13, 2015

(86) PCT No.: PCT/IB2015/058784
§ 371 (c)(1),
(2) Date: May 11, 2017

(87) PCT Pub. No.: WO2016/075666
PCT Pub. Date: May 19, 2016

(65) Prior Publication Data

US 2017/0321969 A1 Nov. 9, 2017

(30) Foreign Application Priority Data

Nov. 14, 2014 (IT) ..... VR2014A0284

(51) Int. Cl.
*F28F 1/32* (2006.01)
*F28F 13/06* (2006.01)
*F28F 13/02* (2006.01)

(52) U.S. Cl.
CPC ..... *F28F 1/32* (2013.01); *F28F 1/325* (2013.01); *F28F 13/02* (2013.01); *F28F 13/06* (2013.01); *F28F 2215/10* (2013.01)

(58) Field of Classification Search
CPC .... F28F 1/32; F28F 1/325; F28F 13/02; F28F 13/06; F28F 2215/10
USPC ..... 165/109.1, 151
See application file for complete search history.

(56) References Cited

U.S. PATENT DOCUMENTS 1,775,041 A * 9/1930 Karmazin ..... F28F 1/325 126/99 D
4,787,442 A * 11/1988 Esformes et al. ..... F28F 1/12 165/151
4,984,626 A * 1/1991 Esformes ..... F28F 1/325 165/151

(Continued)

FOREIGN PATENT DOCUMENTS

CN 102 135 388 A 7/2011
DE 496733 C * 4/1930 ..... F28F 1/325

(Continued)

OTHER PUBLICATIONS

International Search Report and Written Opinion from corresponding International Patent Application No. PCT/IB2015/058784, dated Feb. 19, 2016.

*Primary Examiner* — Joel M Attey
(74) *Attorney, Agent, or Firm* — Tutunjian & Bitetto, P.C.

(57) ABSTRACT

A fin for a finned pack for heat exchangers, includes a plate in which a plurality of through holes is made for the positioning of tubes to convey a first heat exchange fluid, the plate having an edge as well as two main faces each to be contacted by a second heat exchange fluid in a crossing direction from an inlet portion to an outlet portion of the edge of the plate.

17 Claims, 5 Drawing Sheets

(56) References Cited

U.S. PATENT DOCUMENTS

| | | | | |
|---|---|---|---|---|
| 6,578,627 | B1 * | 6/2003 | Liu et al. | F28F 1/32 165/109.1 |
| 8,381,802 | B2 * | 2/2013 | Nishino | F28F 13/12 165/109.1 |
| 8,613,307 | B2 * | 12/2013 | Kim | F28F 1/32 165/151 |
| 2004/0194936 | A1 * | 10/2004 | Torii | F28F 1/32 165/151 |
| 2004/0200608 | A1 * | 10/2004 | Baldassarre | F28D 15/02 165/181 |

FOREIGN PATENT DOCUMENTS

| | | | | | |
|---|---|---|---|---|---|
| EP | 2 072 939 | A1 | | 6/2009 | |
| JP | 61110889 | A | * | 5/1986 | F28F 1/325 |
| JP | 03075498 | A | * | 3/1991 | F28F 1/32 |
| WO | 2011/082922 | A1 | | 7/2011 | |
| WO | 2014/104576 | A1 | | 7/2014 | |

* cited by examiner

FIN FOR A FINNED PACK FOR HEAT EXCHANGERS, AS WELL AS HEAT EXCHANGER

This application is a National Stage Application of International Patent Application No. PCT/IB2015/058784, filed 13 Nov. 2015, which claims benefit of Serial No. VR2014A000284, filed 14 Nov. 2014 in Italy and which applications are incorporated herein by reference. To the extent appropriate, a claim of priority is made to each of the above disclosed applications.

TECHNICAL FIELD OF THE INVENTION

The present invention relates to a fin for a finned pack for heat exchangers, a finned pack and a heat exchanger including the latter.

STATE OF THE PRIOR ART

Heat exchangers are used in many applications for heating or cooling a first fluid, by placing it in heat exchange communication with a second fluid. This is usually obtained by conveying a first fluid into tubes which cross passage zones of the second fluid.

Different types of heat exchangers have been proposed, including those so-called "with finned pack", which comprise a plurality of packed fins; such fins comprise plate-like elements having a plurality of holes in which tubes are engaged for conveying a first fluid, while a second fluid is sent between the fins for the heat exchange with the first fluid.

The fins can have substantially smooth or corrugated geometry, in particular if it is desired to increase the surface area or the efficiency of the heat exchange.

Nevertheless, the heat exchange efficiency in the exchangers according to the state of the prior art is often limited and therefore it is necessary to improve the performances obtainable in heat exchangers.

OBJECTS OF THE INVENTION

One object of the present invention is to provide a new fin of a finned pack for heat exchangers as well as a new finned pack and a new heat exchanger obtainable starting from one such fin.

Another object of the present invention is to provide a new fin of a finned pack that is able to ensure an improved heat exchange efficiency.

Another object of the present invention is to provide a fin as stated above which allows affecting the external surface of the tubes of the exchanger in a uniform manner.

In accordance with one aspect of the invention, a fin is provided according to claim 1.

In accordance with one aspect of the invention, a finned pack is provided according to claim 13.

In accordance with one aspect of the invention, a heat exchanger is provided according to claim 15.

The dependent claims refer to preferred and advantageous embodiments of the invention.

BRIEF DESCRIPTION OF THE DRAWINGS

Other characteristics and advantages of the invention will be clearer from the description of embodiments of fins, of a finned pack and of heat exchangers, illustrated by way of example in the enclosed drawings in which.

In the set of drawings, equivalent parts or components are marked by the same reference numbers.

EMBODIMENTS OF THE INVENTION

Figure 1:
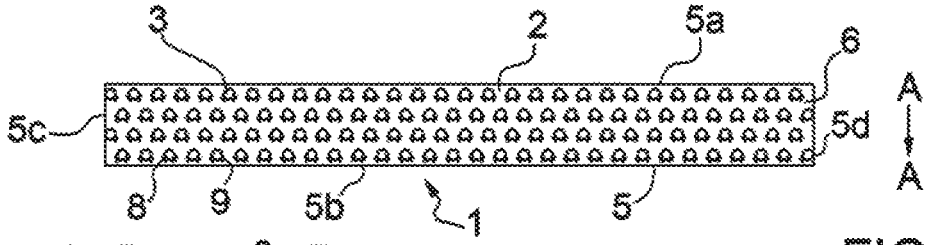
FIG. 1 is a plan view of a fin according to the present invention.
Figure 2:
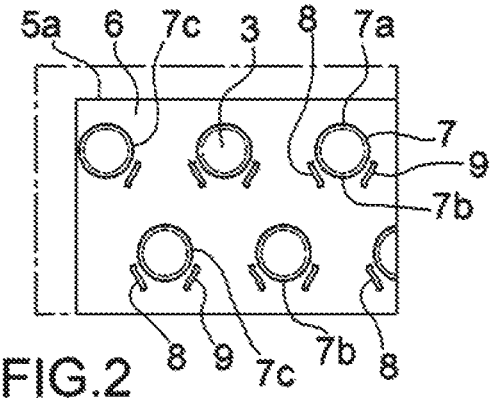
FIG. 2 is a view of a detail in enlarged scale of the fin of FIG. 1.
Figure 3:
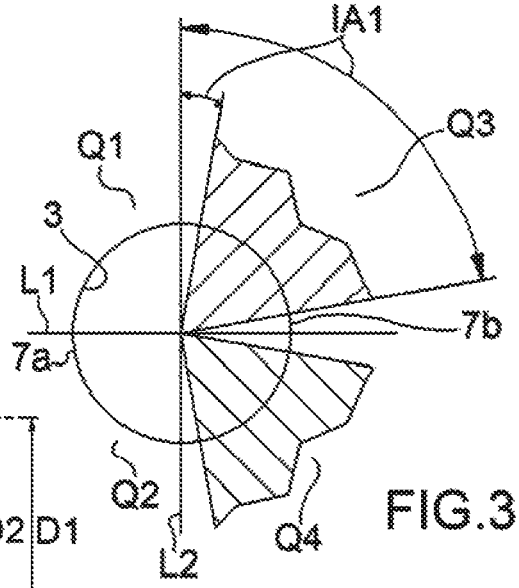
FIGS. 3 and 4 respectively illustrate a hole of a fin with indications of the area of installation of a baffle and a partially surrounded hole according to the embodiment of FIG. 1.
Figure 4:
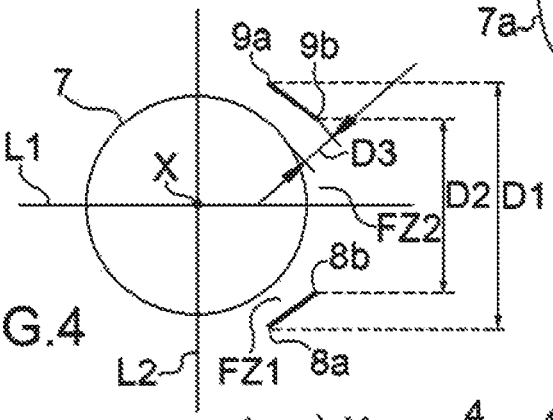
Figure 5:
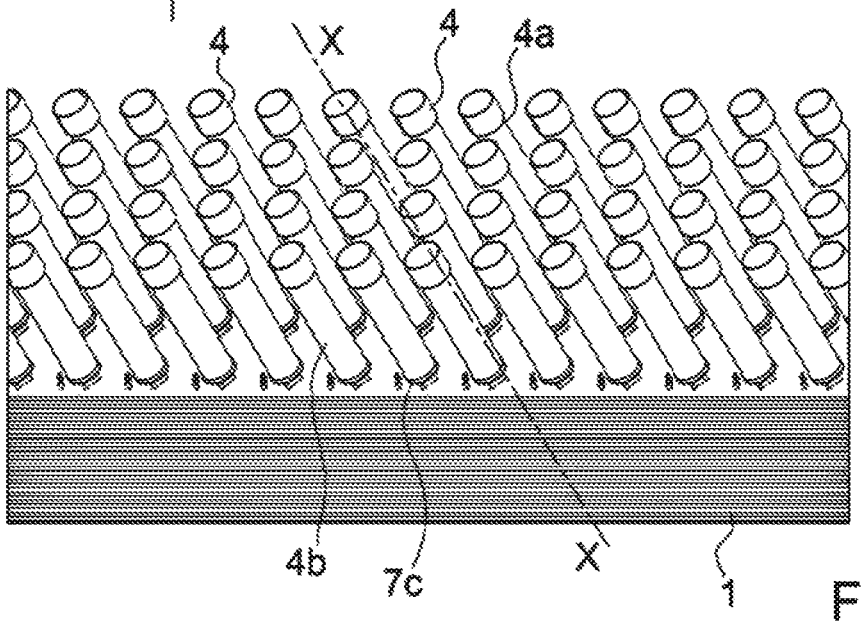
FIG. 5 is a perspective view of a finned pack with a plurality of fins according to FIG. 1.
Figure 6:
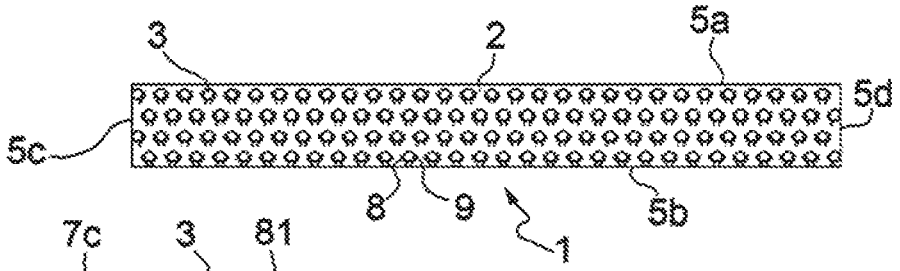
FIGS. 6 to 10 are respectively views similar to FIGS. 1 to 5 with reference to another embodiment of a fin and finned pack in accordance with the present invention.
Figure 7:
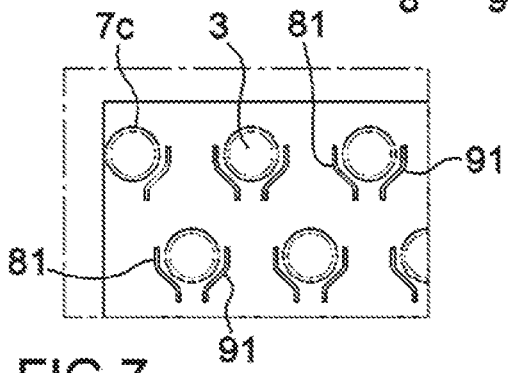
Figure 8:
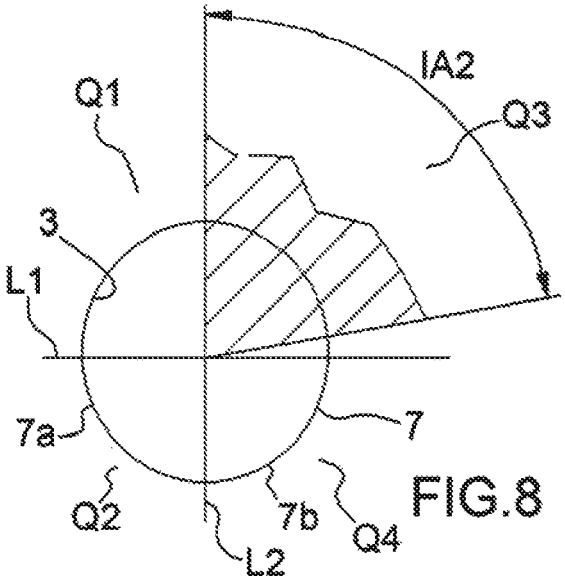
Figure 9:
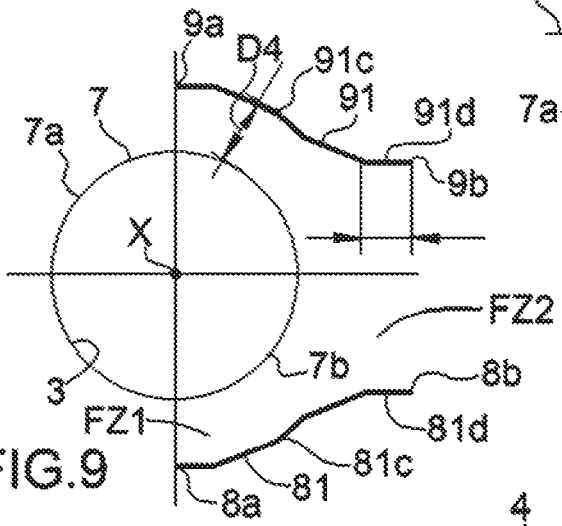
Figure 10:
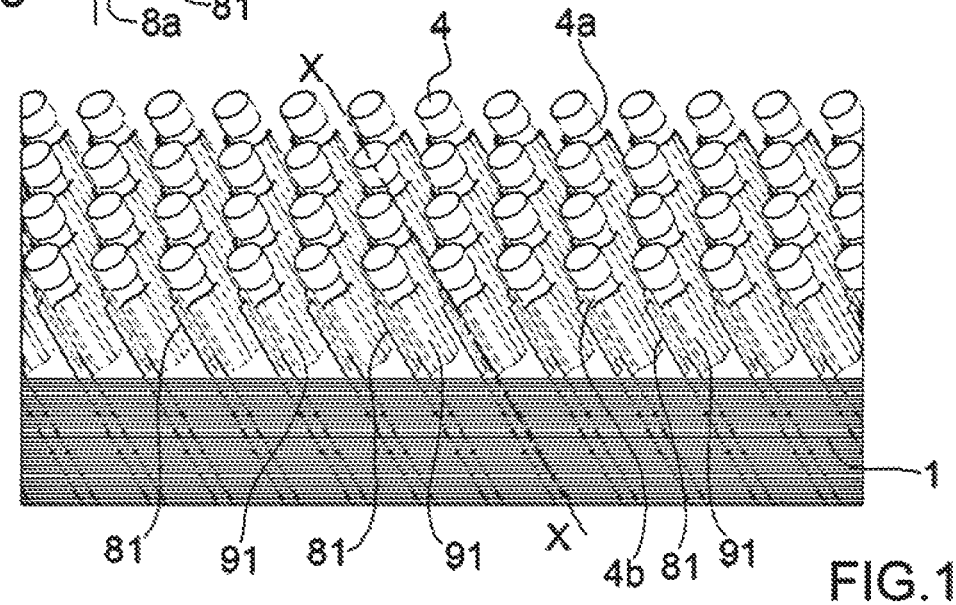
Figure 11:
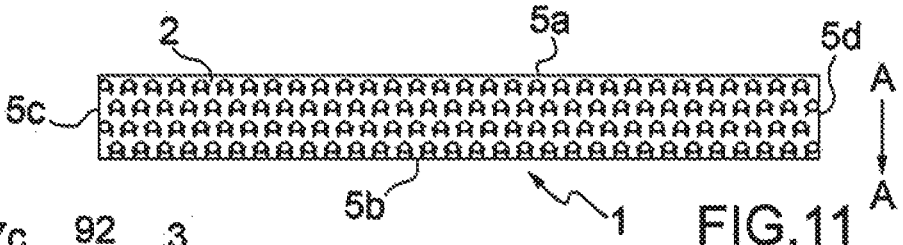
FIGS. 11 to 15 are respectively views similar to FIGS. 1 to 5 with reference to a further embodiment of a fin and finned pack in accordance with the present invention.
Figure 12:
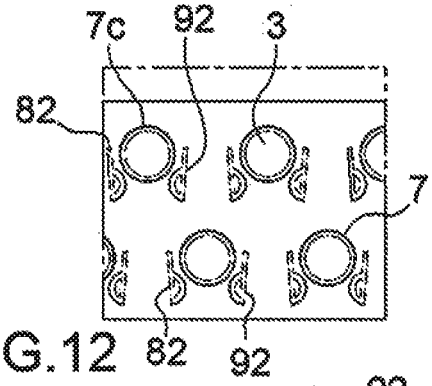
Figure 13:
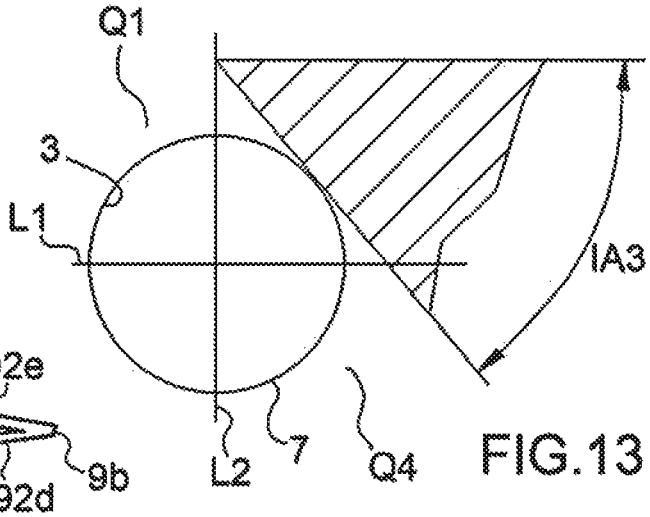
Figure 14:
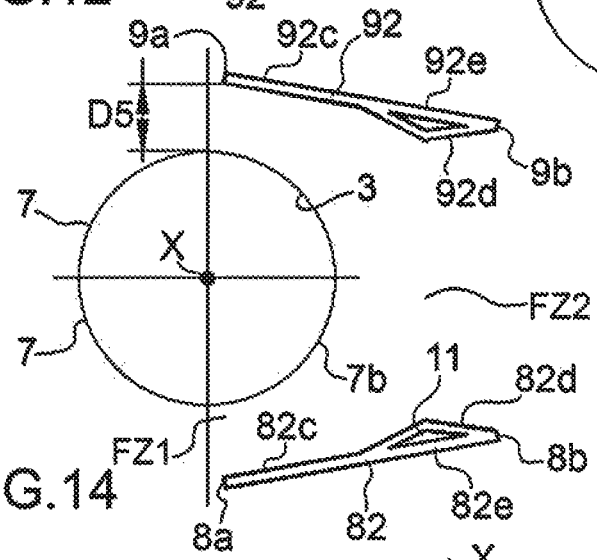
Figure 15:
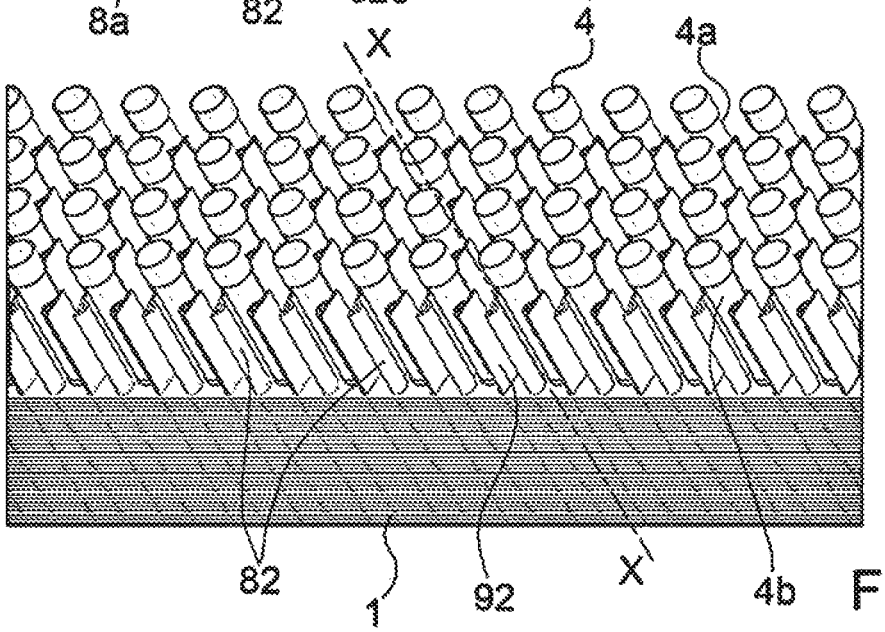

With reference to FIGS. 1 to 5, a fin 1 for a finned pack for heat exchangers is illustrated, which comprises a plate 2 in which a plurality of through holes 3 is made for the positioning of tubes 4 intended to convey a first heat exchange fluid, e.g. a liquid.

The plate 2 has an edge 5 as well as two main faces 6 each intended to be licked or affected by a second heat exchange fluid, such as air, in a crossing direction A-A from an inlet portion 5*a* to an outlet portion 5*b* of the edge 5 of the plate 2. For such purpose, the facing main faces 6 of two adjacent and successive fins 1 delimit, between them, a respective area of passage or crossing of a second fluid which hits respective sections of the tubes 4 engaged in such fins.

The edge 5 actually constitutes an external connection face between the two main faces 6 and the same can be provided with two main sides main sides 5*a*, 5*b*, e.g. parallel, which are connected like a bridge by means of secondary or smaller sides 5*c*, 5*d*, if desired these too parallel and orthogonal to the main sides. The main sides 5*a*, 5*b* actually respectively constitute the inlet portion 5*a* and the outlet portion 5*b*.

The holes 3 are delimited by a respective inner delimiting wall 7 of the plate 2, which includes a first portion 7*a* facing towards the inlet portion 5*a* and a second portion 7*b* facing towards the outlet portion 5*b*. The delimiting wall 7 of the holes 3 can be substantially cylindrical.

The fin 1 then comprises one or more confinement units 8, 9 for the flow of the second fluid, each confinement unit being arranged around a respective section of the second portion 7*b* of the delimiting wall 7 of a hole 3 of the plurality of holes so as to obtain or define a partially surrounded hole or better yet a respective partially surrounded hole 3. Preferably, a confinement unit 8, 9 is provided for each hole 3 of the fin 1 or in any case for most of the holes 3 of the fin itself. Still more preferably, the confinement units do not affect or better yet are not arranged around the first portion 7*a* of the respective delimiting wall 7.

More particularly, at least one confinement unit comprises two first baffles 8, 9 or two through housing recesses for housing second baffles arranged one opposite the other with respect to a respective partially surrounded hole 3, as well as each surrounding and spaced from a respective section of the second portion 7*b* of the delimiting wall 7 of the partially surrounded hole 3, so as to confine, during use, on the plate 2 a first flow zone FZ1 of the second fluid between each baffle 8 or recess and a respective section of the second portion 7*b* of the delimiting wall 7.

The configuration that will be described with reference to the first baffles is in substance also applied to the second baffles and vice versa, if it is considered that, once a finned pack is assembled, such components (first or second baffles) are intended to carry out the same task in substantially the same manner.

The first flow zone FZ1 comprises an introduction mouth for the second fluid, delimited between the plate 2, the first baffles 8, 9 and a part of the delimiting wall 7 as well as a delivery mouth for the second fluid leading into an area downstream of the respective hole 3, i.e. an area subsequent to the hole 3 in the sense of the crossing direction A-A. The first flow zone FZ1 or better yet the walls thereof are fluid-tight so as to prevent leaks or exits of liquid between the introduction mouth and the delivery mouth.

With regard to the introduction mouth, this is preferably delimited between the plate 2, a first end 8*a*, 9*a* of the first baffles 8, 9 or recesses and a part of the second portion 7*b* of the delimiting wall 7.

Advantageously, the first baffles 8 or the recesses can also be extended beyond a respective hole, i.e. have end sections closer to the outlet portion 5*b* with respect to a respective hole and hence define a second flow zone FZ2, which actually constitutes a continuation of the first flow zone FZ1, such second flow zone FZ2 being delimited between end sections of the first baffles 8, 9 or recesses.

In such a manner, a confinement of the second fluid is obtained downstream of the partially surrounded hole 3, with the expression confinement "downstream" indicating a confinement of the second fluid in the area or zone of the fin 1 that such fluid crosses after having affected the hole 3 or better yet hit the tube 4 engaged in the hole 3.

The second flow zone FZ2 has a feeding mouth corresponding to the delivery mouth of the first flow zone FZ1 as well as a mouth for discharging the second fluid towards subsequent holes or parts of the fin with reference to the crossing direction A-A. The second flow zone FZ2 or better yet the walls thereof are fluid-tight so as to prevent leaks or exits of fluid between the delivery mouth and the discharge mouth.

Advantageously, the holes 3 are each extended around a respective axis of symmetry x-x, with the axes of symmetry x-x of the holes 3 being substantially parallel to each other, while the first baffles 8, 9 or the housing recesses for second baffles of a confinement unit 8, 9 are substantially symmetrical to one another with respect to a plane passing through the crossing direction A-A from an inlet portion 5*a* to an outlet portion 5*b* of the edge 5 and (passing) through the axis of symmetry x-x of the respective at least partially surrounded hole 3.

In addition, the delimiting wall 7 can have a collar section 7*c* projecting upward with respect to one of the main faces 6, while the first baffles 8, 9 of the partially surrounded hole 3 with collar section 7*c* are extended around at least one part of the collar section 7*c* distal from the inlet portion 5*a* and facing towards the outlet portion 5*b*, the first or second baffles having height or thickness equal to or less than the collar section 7*c*. The collar section 7*c* of the delimiting walls 7 mainly carries out the function of spacer between two adjacent and successive fins 1 of a finned pack.

Advantageously, the first baffles 8, 9 or the recesses of one or more confinement units 8, 9 have a first end 8*a*, 9*a* proximal to the inlet portion 5*a* as well as a second end 8*b*, 9*b* distal from the inlet portion 5*a* of the plate 2. The proximal ends 8*a*, 9*a* of the first baffles 8, 9 or housing recesses are at a first distance D1 from each other, while the distal ends 8*b*, 9*b* of the first baffles 8, 9 or recesses of a confinement unit are at a second distance D2 from each other which is advantageously less than the first distance D1, such that the first baffles or recesses delimit between them a first area substantially tapered going away from the inlet portion 5*a*. In addition, in such case, preferably there are no intermediate sections of the first baffles 8, 9 with distance between them greater than the first distance D1 between the proximal ends 8*a*, 9*a*.

If desired, the distance between the first baffles 8 could initially decrease going away from the inlet portion 5*a* and then, once a minimum value is attained at an intermediate portion of the first baffles, once again increase up to the second end 8*b*, 9*b*, in which case the distance between the first baffles at the respective second end 8*b*, 9*b* could also be greater than the distance D1. In such case, the area between the proximal ends and the intermediate portions of the first baffles or of the housing recesses is substantially tapered in the direction going away from the inlet portion 5*a*, while a second area would be provided between the intermediate portions and the second ends of the first baffles or of the housing recesses with an initial section with decreasing cross section and then an end section with increasing cross section going away from the inlet portion 5*a*.

In addition, the (first and/or second) baffles can have a flat or slightly curved laminar body with position, preferably, orthogonal or projecting upward with respect to the plate 2. In addition, the (first and/or second) baffles are, preferably, fluid-tight (if desired they are not perforated) so as to prevent the passage of the second fluid through them. In addition, each baffle is preferably formed in a single piece.

If desired, the first baffles comprise a drawn portion, or sheared and bent portion of the plate 2, i.e. the baffles 8, 9 are obtained by means of drawing of the plate 2 itself. If a collar section 7*c* is provided, then both the first baffles 8, 9 and the collar sections 7*c* are obtained by means of drawing of a respective plate 2.

Alternatively, the (first and/or second) baffles 8, 9 can comprise a laminar body with position substantially orthogonal to the plate 2; such laminar body can be in part or separately formed with respect to the plate 2 and connected, if desired via welding or fitting, with the plate 2. In addition, second baffles could be separately formed, each inserted in a respective housing recess of a confinement unit 8, 9; such baffles could have configuration and, during use, arrangement substantially corresponding to the baffles 8, 9.

The height or thickness of the (first and/or second) baffles 8, 9 could vary from about 0.1 mm to about 12 mm.

In addition, in order to define the position of the baffles, one or more holes 3 with substantially circular cross section, and the first portion 7*a* and the second portion 7*b* with substantially semi-circular cross section, will be considered.

The following will also be defined in a plane transverse or orthogonal to the axis x-x: first straight line L1, that defined by the crossing direction A-A and passing through the axis of symmetry x-x, and second straight line L2, that orthogonal to the first straight line L1 and always passing through the axis of symmetry x-x.

Quadrants will then be defined, which are always delimited in a plane transverse or orthogonal to the axis x-x, between the first L1 and the second L2 straight line and, more particularly, first Q1 and second Q2 quadrant are those defined between first L1 and second L2 straight line and enclosing a respective half or part of the first portion 7*a* (or within which such portion lies), and third Q3 and fourth Q4 quadrant are those defined between first L1 and second L2 straight line and enclosing a respective half or part of the second portion 7*b*.

On the basis of the considerations and definitions provided up to now, the baffles 8, 9 or the housing recesses can then each be advantageously positioned with one in the third quadrant Q3 and the other in the fourth quadrant Q4, and still more advantageously, each in a circular-sector shaped area defined by a straight line coming out from the axis x-x and tilted at a tilt angle IA1 between 10° and 80° with respect to the second straight line L2.

In addition, each baffle 8, 9 or recess can be at a third distance D3 from the delimiting wall 7 and more particularly from a section of the second portion 7*b* of the delimiting wall 7 between about 1 mm and about 10 mm.

A fin like that illustrated in FIGS. 1 to 5 allows reducing the so-called "dead zone" downstream of the tubes, with reference to the direction A-A of the flow of the second fluid.

The baffles 8, 9 or in any case the baffles engageable in the housing recesses in fact determine, as can be ascertained, a conveying or confinement of the second fluid on the second portion 7*b* of the respective delimiting wall 7 and then towards the respective tube 4, which ensures that each portion of the delimiting wall 7 and hence of the respective tube is affected by the second fluid.

With reference now to the embodiment illustrated in FIGS. 6 to 10, the baffles 81, 91 or recesses have a first section 81*c*, 91*c* surrounding and spaced from a respective section of the second portion 7*b* of the delimiting wall 7 of a partially surrounded hole 3 as well as a second section 81*d*, 91*d* projecting upward from the first section 8*c* and for example substantially parallel to the direction A-A.

The baffles 81, 91, in addition to reducing the "dead zone", increase the surface heat exchange coefficient around the zones of the tubes 4 with high temperature.

Such baffles 81, 91 could be metal sections obtained via extrusion, molding or shaping and mechanically inserted in the fins of a finned pack or better yet in the plates thereof, e.g. with forced insertion or insertion via interference or by means of the use of welding materials or alloys that facilitate the adhesion and transmission of the heat.

On the basis of the considerations and definitions provided above, the first section 81*c*, 91*c* of the baffles 81, 91 or respective housing recesses are each advantageously positioned with one in the third quadrant Q3 and the other in the fourth quadrant Q4, and still more advantageously, each in a circular-sector shaped area defined by a straight line coming out from the axis x-x and tilted at a tilt angle IA2 between 0° and 80° with respect to the second straight line L2.

The first section 81*c*, 91*c* can also be substantially straight or curved or, if desired, with multiple sections that are slightly tilted from one other, but each tilted at an angle between 0° and 80° with respect to the second straight line L2.

In addition, each baffle 81, 91 or recess or better yet the first section 81*c*, 91*c* of each baffle 81, 91 can be at a fourth minimum distance D4 from the delimiting wall 7 and more particularly from a part of the second portion 7*b* of the delimiting wall 7 between about 1 mm and about 15 mm.

The second section 81*d*, 91*d* can instead have extension less than or equal to the distance between two successive rows of holes 3, wherein by row of holes 3 or tubes 4 it is intended the set of holes of a fin or of the tubes engaged therein at a same distance from the inlet portion 5*a* and by successive rows it is intended rows arranged one after the other in the sense of the crossing direction A-A and that thus, during use, are affected by the flow of the second fluid one after the other.

For such purpose, a fin according to the present invention preferably comprises two or more rows of holes 3 offset with respect to one another with respect to the crossing direction A-A, such that each row of holes 3 is at a different distance from the inlet portion 5*a* with respect to the other rows of holes 3.

The thickness of a baffle, as now described, can vary between 0.1 and 5 mm.

With reference now to the embodiment illustrated in FIGS. 11 to 15, a further embodiment is illustrated of a fin provided with baffles 82, 92 with shaped profile, which have a first section 82*c*, 92*c* and a second section 82*d*, 92*d* similar to the first 81*c*, 91*c* and second 81*d*, 91*d* section of the now described embodiment, but also provide for a reinforcement section 82*e*, 92*e* which is extended at the face of the respective baffle 82, 92 facing away from the respective partially surrounded hole 3 and more particularly from an intermediate zone thereof to the free end of the second section 82*d*, 92*d*, i.e. the end distal from the inlet portion 5*a*.

According to such embodiment, the first section 82*c*, 92*c* is substantially rectilinear, while the second section 82*d*, 92*d* has a configuration that is curved or with two sections slightly tilted with respect to one other and defining, with the reinforcement section 82*e*, 92*e*, an opening or first opening 11, e.g. with substantially triangular section, if desired extended substantially parallel to the axis of symmetry x-x of the respective hole 3.

Such opening 11 is typically used for the passage through the respective baffle, i.e. in direction substantially parallel to the axis x-x, of a third fluid such to increase the exchange efficiency of the exchanger or for complementary functions such as to the melting of frost in the case of operation of the exchanger as air heater. In addition, the opening 11 could also be fed with the first fluid.

It should also be observed that the baffles 8, 9 and 81, 91, previously described, could have an opening 11, so as to have a substantially tubular structure with through opening extended substantially parallel to the axis of symmetry x-x of the respective hole 3. With regard to the baffles 81, 91, these could have the first 81*c*, 91*c* and/or the second section 81*d*, 91*d* substantially tubular.

The first opening 11 of one or more baffles could have a section with any suitable shape. e.g. circular, elliptical, rectangular or polygonal.

In addition, two or more openings or micro-channels 11 could also be provided in each baffle.

Clearly, an opening 11 as indicated above can in particular be present if the baffles comprise metal sections obtained—via extrusion, molding or shaping—separately with respect to the plates 2 and hence mechanically inserted in the plates 2 themselves.

Due to such baffles 82, 92, a fin according to the embodiment of the FIGS. 11 to 15 is capable of making the respective finned pack self-supporting, increasing the heat exchange and increasing the speed of the fluid and the "primary" surface adapted to contain or delimit the passage of the second fluid.

The baffles 82, 92 can comprise profiles or sections, e.g. metal, obtained via extrusion or shaping, if desired with longitudinal welding, which can be mechanically inserted by means of interference or fixed to the fins or better yet to the plates thereof with high-conductivity welding materials.

Each baffle 82, 92 or recess can be at a fifth distance D5 from the delimiting wall 7 and more particularly from a section of the second portion 7*b* of the delimiting wall 7 between about 1 mm and about 15 mm.

Each baffle 82, 92 in a respective third Q3 or fourth Q4 quadrant then has tilt angle IA3 between 0° and 50° with respect to the straight line L2.

The first flow zone FZ1 between each baffle 82, 92 and a respective section of the second portion 7*b* can vary between 5 $mm^2$ and the value of the passage section of the tube for the passage of the primary fluid or first fluid.

The thickness of a baffle 82, 92, as now described, can also vary between 0.1 and 12 mm.

With reference now in particular to the geometry and distribution of the holes in a fin according to the present invention, the following will be defined:

the line or row of holes 3 or of tubes 4 is the set of holes of a fin or of the tubes engaged therein at a same distance from the inlet portion 5*a;*

A is the pitch or distance of the holes 3 or tubes 4 of a same row of tubes times the number of tubes of such row; and B is the pitch or distance of the lines times the number of lines.

Based on such definitions, a fin according to the present invention could have A×B between 10×10 and 100×100.

Hereinbelow, the table reports several possible geometries and sizes for a fin according to the present invention as well as for the tubes to be engaged therein.

| Geometry A × B | C | D | Pitch of fins (mm) | ϕ tube (mm) | Arrangement of tubes or holes |
|---|---|---|---|---|---|
| 25 × 21.65 | 11 | 6.25 | 1.6-3.6 | 7.2 | Offset |
| 25 × 21.65 | 11 | 6.25 | 1.6-3.6 | 7.94 | Offset |
| 25 × 21.65 | 11 | 6.25 | 1.6-5 | 9.52 | Offset |
| 25 × 25 | 12.5 | 12.5 | 1.6-3.5 | 9.52 | Squared pitch |
| 25 × 50 | 25 | 12.5 | 1.6-3.2 | 9.52 | Squared pitch |
| 30 × 26 | 13 | 12.5 | 1.6-5 | 9.52 | Offset |
| 30 × 26 | 13 | 12.5 | 1.6-5 | 12 | Offset |
| 37.5 × 32.5 | 16.25 | 9.37 | 4-8 | 9.52 | Offset |
| 37.5 × 32.5 | 16.25 | 9.37 | 1.6-8 | 12 | Offset |
| 50 × 25 | 25 | 25 | 2.5-12 | 12 | Offset |
| 50 × 25 | 25 | 25 | 2.5-12 | 15.88 | Offset |
| 50 × 25 | 25 | 25 | 2.5-12 | 12 | Squared pitch |
| 50 × 25 | 25 | 25 | 2.5-12 | 15.88 | Squared pitch |
| 50 × 50 | 25 | 25 | 2.5-12 | 12 | Squared pitch |
| 50 × 50 | 25 | 25 | 2.5-12 | 15.88 | Squared pitch |
| 50 × 50 | 25 | 25 | 2.5-12 | 12 | Offset |
| 50 × 50 | 25 | 25 | 2.5-12 | 15.88 | Offset |
| 30 × 30 | 15 | 15 | 1.8-7 | 15.88 | Squared pitch |
| 30 × 30 | 15 | 15 | 1.8-7 | 15.88 | Offset |
| 60 × 30 | 15 | 15 | 1.8-7 | 15.88 | Squared pitch |
| 60 × 30 | 15 | 15 | 1.8-7 | 15.88 | Offset |
| 60 × 60 | 15 | 15 | 1.8-7 | 15.88 | Squared pitch |
| 60 × 60 | 15 | 15 | 1.8-7 | 15.88 | Offset |

For such purpose, by C and D it is intended the distances between the holes at the edges of the plate 2 and the sides of the edge of the respective plate 2. The above-reported values for C and D are naturally merely given for exemplifying purposes.

In addition, a fin could also have A×B equal to 48×41.75 or 50×40 with tubes of diameter equal to 12 mm or 16 mm, or A×B equal to 20×20 with tubes having 5 mm diameter.

With regard instead to the definition of "offset" of the tubes or holes: it is intended that the holes of adjacent and successive rows are offset with reference to the crossing direction A-A, while the definition "squared pitch" indicates that the holes or the tubes of adjacent and successive rows are aligned, always with reference to the crossing direction A-A. For such purpose, in a fin according to the present invention, each row of holes 3 comprises at least one hole aligned along the crossing direction A-A with a respective hole of the other rows of holes and/or at least one hole offset with respect to the holes 3 of the other rows of holes 3, always with reference to the crossing direction A-A.

In substance, a fin according to the present invention comprises two or more lines or rows of holes 3, i.e. groups of holes substantially at a same distance from the inlet portion 5*a*. In addition, the holes of adjacent and successive rows can be offset or aligned with reference to the crossing direction A-A.

In addition, in a fin according to the present invention, holes for the positioning of heating elements could also be provided (or not provided), e.g. through holes with diameter equal to 9.5 mm.

The thickness of a fin according to the present invention can vary between 0.1 mm and 0.4 mm.

The pitch or distance between the fins can vary between 1.2 and 12 mm.

A fin 1 according to the present invention can then have a smooth surface or so-called "w_vaffle", "pyramid" or "turbulent" surface. Such fin can also have a so-called "jagged" or "smooth" edge.

The fin 1 could be made of any suitable material, e.g. aluminum, aluminum alloys, copper, copper alloys, steel, stainless steel in different alloys, such as AISI 304, AISI 316, etc.

In addition, the fin 1 could be finished with surface treatments, e.g. varnishing, cataphoresis or other treatments.

Figure 16:
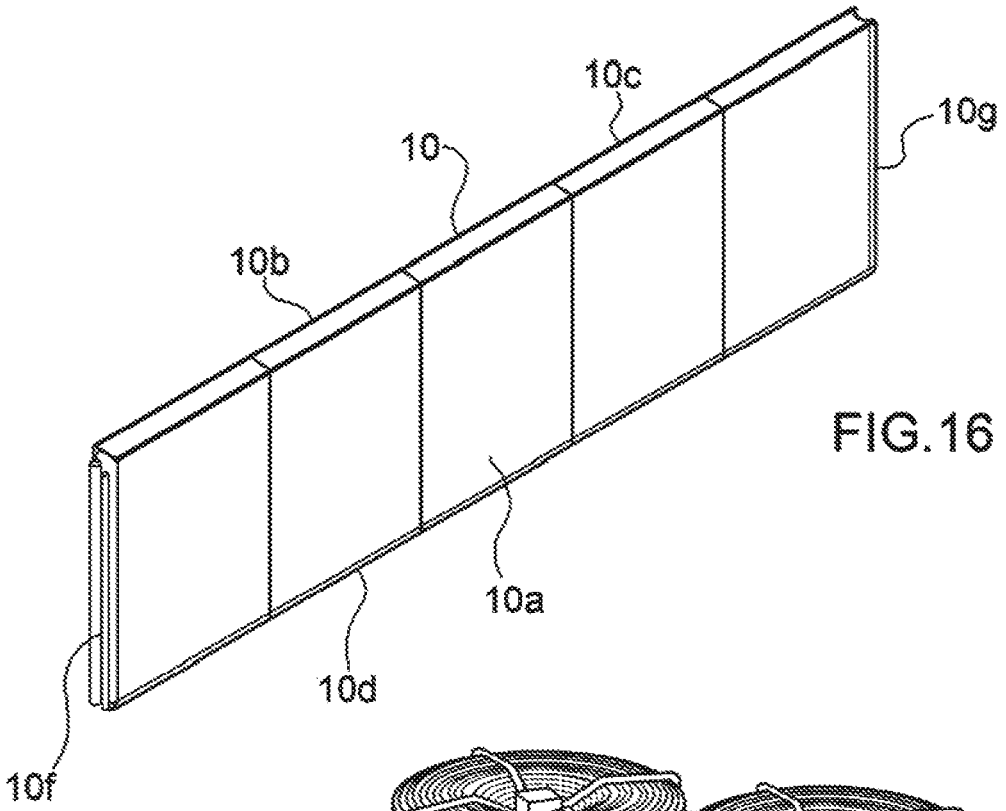
FIG. 16 is a view of a finned pack according to the present invention and including a fin in accordance with the present invention.

With reference now to FIG. 16, a finned pack 10 according to the present invention for heat exchangers is illustrated, which comprises a plurality of fins 1 according to the present invention, arranged in succession one after the other or one next to the other and substantially parallel to each other. Each fin 1 also has its through holes 3 aligned with the through holes 3 of the other fins 1.

The finned pack 10 then comprises an introduction opening 10*a* for a second fluid between pairs of fins of the plurality of fins, and an outlet opening 10*b* for the second fluid between the pairs of fins. The fins 1 have their inlet portions 5*a* at the introduction opening 10*a* and their outlet portions 5*b* at the outlet opening 5*b*.

A plurality of tubes 4 inserted in the aligned through holes of the plurality of fins 1 are also provided in the exchanger, the tubes 4 having a first sector 4*a* facing towards the inlet opening 10*a* as well as a second sector 4*b* facing towards the outlet opening 10*b*, the fins 1 having the confinement unit or units 8, 9 around a portion of a second sector of a respective tube 4.

As already stated above, the facing main faces 6 of two adjacent and successive fins 1 delimit, between them, a respective area of passage or crossing of a second fluid which hits respective sections of the tubes 4 engaged in such fins, and such tubes 4 along with the baffles are extended through the passage areas so as to be hit by the flow of the second fluid.

The finned pack 10 can then comprise an upper tile 10*c*, a lower tile 10*d* and, additionally, at one side manifolds 10*f* for the tubes 4 and on the other side small forks 10*g* for sending the first fluid between two tubes 4.

If desired, each fin has at least one confinement unit with two through recesses for positioning baffles and each through recess of each confinement unit is aligned with a respective recess of the other fins. In such case, the finned pack also comprises two baffles for each confinement unit, each inserted in a respective series of aligned through recesses of the fins 1, preferably of all the fins of the finned pack 10.

According to such variant, the baffles or bars could constitute a load-bearing mechanical element of the finned pack 10. This is particularly applied to the embodiments illustrated in FIGS. 6 to 15.

In addition, if the baffles delimit an opening 11, the finned pack 10 or better yet the respective heat exchanger could comprise means for feeding a third fluid or the first fluid into the opening 11 of one or more baffles 8, 9, 81, 91, 82, 92. In such case, at the ends of the baffles 8, 9, 81, 91, 82, 92, pipe unions could be provided, along with tubular connection elements between the end of one baffle and a respective end of another baffle. In substance, in such case a feed circuit could be provided for a third fluid constituted by the baffles connected together in series and/or in parallel. Alternatively, the baffles could be connected in series and/or in parallel with each other and with the tubes 4, such that baffles and tubes would be fed with the first fluid.

The tubes 4 of a finned pack 10 could for example be made of copper and alloys thereof, stainless steel and alloys thereof, iron and alloys thereof, aluminum and alloys thereof or other suitable materials.

The tubes could also have an internal wall that is smooth, or grooved, e.g. tilted groove, helical grooved or grooved with crossed spirals.

The tubes could then have a diameter between 4 and 35 mm, advantageously between 5 and 22 mm, preferably 5 mm, 6.35 mm, 7.2 mm, 7.9 mm, 9.5 mm, 12 mm, 14, 16 mm or 22 mm.

The thickness of the tubes instead preferably varies between 0.15 and 1.50 mm, and, still more preferably, it is equal to 0.25 mm, 0.28 mm, 0.32 mm, 0.35 mm, 0.4 mm or 0.5 mm.

Figure 17:
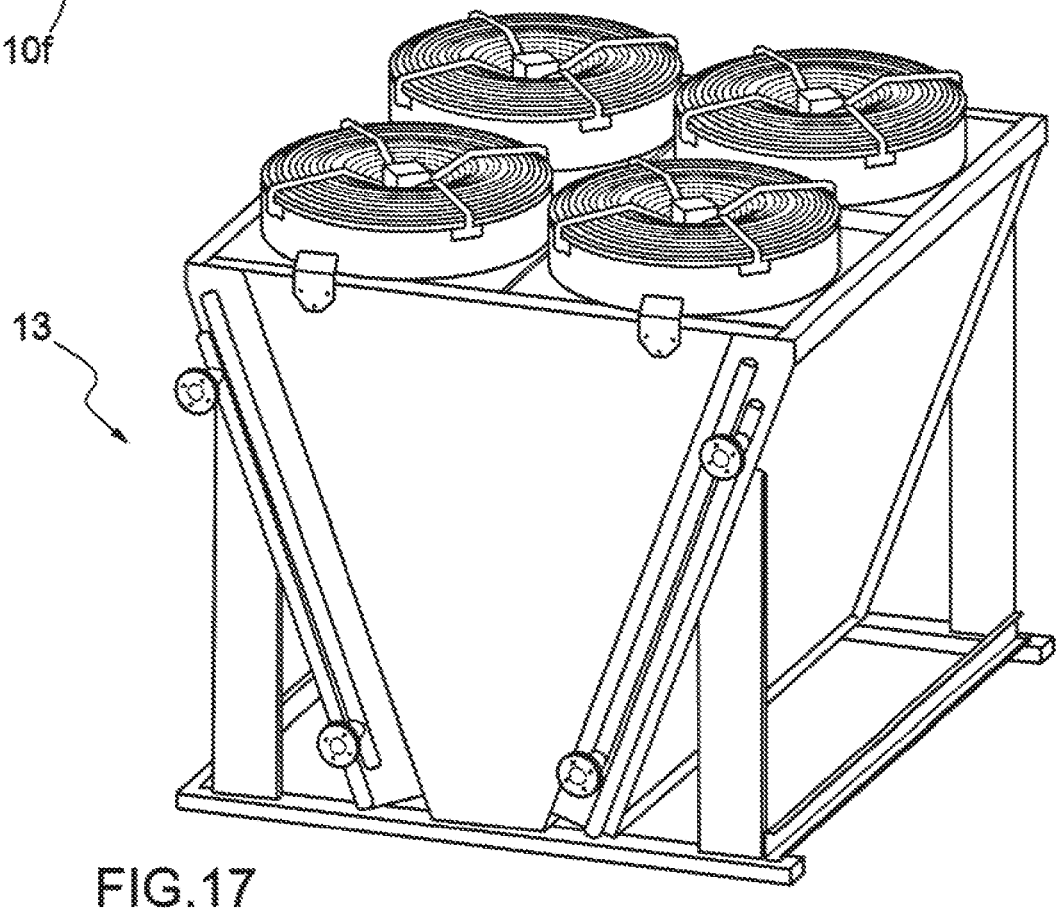
FIGS. 17 to 19 are views of heat exchangers in which a finned pack according to the present invention can be installed.
Figure 18:
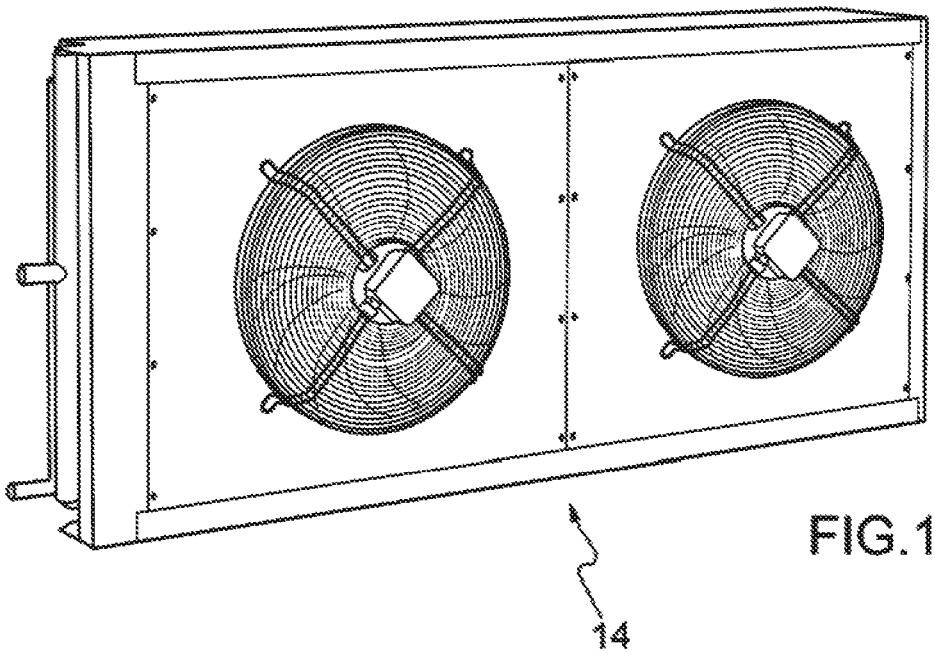
Figure 19:
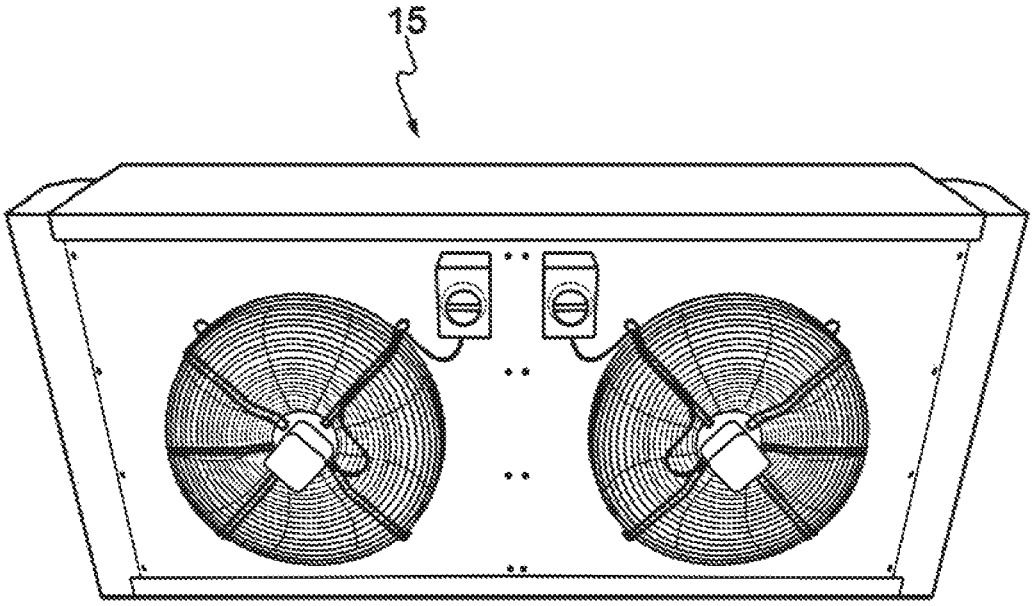

A finned pack according to the present invention can be integrated or installed in:

- a fluid condenser or cooler 13 (see FIG. 17), i.e. a machine intended for the heat exchange between a coolant fluid to be cooled and the environment, which can employ liquid, aeriform or gaseous coolant fluids;
- in a gas cooler 14 (see FIG. 18), e.g. with $CO_2$, which is a cooler intended for the heat exchange between a coolant fluid, such as $CO_2$ to be cooled, and the environment; or
- in a dry cooler 15 (see FIG. 19), it too intended for the heat exchange between a coolant fluid to be cooled and the environment which can employ liquid, aeriform or gaseous coolant fluids.
- an air evaporator or air cooler, i.e. a machine intended for the heat exchange between a coolant fluid being evaporated/heating and a secondary fluid to be cooled, which can employ liquid, two-phase or gaseous coolant fluids;

As will be understood, a fin and a finned pack according to the present invention allow conveying the second fluid around the entire surface of the holes and hence of the tubes of the fin, also in the zone of each tube that faces towards the outlet portion.

For such purpose, in fact, the applicants of the present patent application have been able to establish that with fins and finned packs according to the state of the art, the second fluid correctly and uniformly hits and affects the part of the tubes facing towards the inlet portion of the fins, but in the zone between the tubes of one row and the tubes of a subsequent row, the second fluid is "detached" from the external surface of the tubes, hence not affecting that part of the tubes facing towards the outlet portion of the fins. Naturally, this involves a considerable reduction of the heat exchange efficiency, since most of the external face of the tubes crossed by the first fluid is not in heat exchange contact with the second fluid.

Due to the confinement units of a fin according to the present invention and of a respective finned pack, the second fluid is instead in fact guided and maintained next to the tubes, even in the zone downstream thereof, so as to affect the second fluid and place it in heat exchange with the entire external face of the tubes, considerably improving the obtainable heat exchange efficiency.

Modifications and variants of the invention are possible within the protective scope defined by the claims.

The invention claimed is:

1. A fin for a finned pack for heat exchangers, comprising:

a plate in which a plurality of through holes is made for positioning of tubes adapted to convey a first heat exchange fluid; said plate having:

an edge;

two main faces each adapted to be contacted by a second heat exchange fluid in a crossing direction from an inlet portion to an outlet portion of said edge of said plate; and said holes being delimited by a respective inner delimiting wall of said plate including a first portion facing towards said inlet portion and a second portion facing towards said outlet portion, said fin comprising at least one confinement unit of said second heat exchange fluid arranged around a hole of said plurality of holes to obtain at least one partially surrounded hole, said at least one confinement unit comprising two baffles arranged one opposite the other with respect to each respective partially surrounded hole and surrounding and spaced from a respective section of said second portion of said delimiting wall of said partially surrounded hole, so as to confine, during use, on said plate a first flow zone of said second heat exchange fluid between each baffle or recess and a respective section of said second portion of said delimiting wall, wherein said baffles comprise a drawn portion of said plate, wherein said baffles have a first section, a second section as well as a reinforcement section which is extended at the face of the respective baffle facing away from the respective partially surrounded hole and is extended from an intermediate zone of said first section to the free end of said second section.

2. The fin according to claim 1, wherein the baffles have a first end proximal to said inlet portion, a second end distal from said inlet portion of said plate and an intermediate portion between said first and said second end;

said first ends being at a first distance from each other, while said second ends or said intermediate portion are at a second distance from each other that is less than said first distance, such that the baffles or housing recesses delimit between the baffles at least one first area substantially tapered in a direction going away from said inlet portion.

3. The fin according to claim 1, wherein said first flow zone comprises:

an introduction mouth for the second heat exchange fluid, delimited between said plate, said baffles and a part of said delimiting wall as well as a delivery mouth for the second heat exchange fluid leading into an area of said plate subsequent to said hole in the direction of said crossing direction.

4. The fin according to claim 1, wherein said baffles are extended beyond a respective partially surrounded hole, so that said baffles or said housing recesses have end sections closer to said outlet portion with respect to a respective partially surrounded hole and defining a second flow zone constituting a continuation of said first flow zone, said second flow zone having a feeding mouth corresponding to said delivery mouth of said first flow zone as well as a discharge mouth of said second heat exchange fluid towards parts of said fin that follow in the sense of said crossing direction.

5. The fin according to claim 1, wherein each one of said holes of said plurality of holes extends around a respective axis of symmetry, the axes of symmetry of said holes being substantially parallel to each other, and wherein said baffles are substantially symmetrical to one another with respect to a plane passing through said crossing direction and through the axis of symmetry of the respective at least partially surrounded hole.

6. The fin according to claim 1, wherein said delimiting wall of at least one partially surrounded hole has a collar section projecting upward with respect to one of said main faces, while the baffles surrounding said partially surrounded hole with collar section are extended around at least one part of said collar section distal from said inlet portion and facing towards said outlet portion, said baffles having height or thickness equal to or less than said collar section.

7. The fin according to claim 1, wherein said baffles comprise a flat or slightly curved laminar body with position orthogonal or projecting upward with respect to said plate.

8. The fin according to claim 1, wherein said baffles are fluid-tight, so as to prevent passage of the second heat exchange fluid through them.

9. The fin according to claim 1, wherein at least one hole of said plurality of holes has a substantially circular cross section, while said first portion and said second portion have substantially semi-circular cross section, and wherein said baffles arranged around said at least one hole with substantially circular cross section are positioned with one in a third quadrant and the other in a fourth quadrant, and each of said baffles is positioned in a circular-sector shaped area defined by a straight line coming out from said axis of symmetry and tilted at a tilt angle between 0° and 80°, between 10° and 80° or between 0° and 50° with respect to a second straight line, wherein in a plane transverse or orthogonal to an axis of symmetry of said hole with substantially circular cross section, first straight line is defined as a straight line parallel to the crossing direction and passing through said axis of symmetry and second straight line is defined as the straight line orthogonal to said first straight line and passing through said axis of symmetry, and wherein quadrants are those delimited, in a plane transverse or orthogonal to said axis of symmetry, between said first and said second straight line, and wherein a first quadrant and a second quadrant are defined between said first straight line and said second straight line and enclose a respective half or part of said first portion, while a third quadrant and a fourth quadrant are those defined between first and second straight line and enclosing a respective half or part of said second portion.

10. The fin according to claim 1, wherein each baffle is at a third distance from a section of said second portion of said delimiting wall between about 1 mm and about 10 mm or each baffle or housing recess is at a fourth distance from a part of said second portion of said delimiting wall between about 1 mm and about 15 mm.

11. The fin according to claim 1, wherein said baffles have a substantially tubular structure so as to delimit at least one first opening.

12. The fin according to claim 11, wherein said at least one first opening is extended substantially parallel to the axis of symmetry of the respective hole and is set to allow the passage through the respective baffle and in a direction substantially parallel to said axis of symmetry of a third fluid or of said first fluid.

13. The fin according to claim 1, further comprising at least one first opening defined between said second section and said reinforcement section.

14. A fin for a finned pack for heat exchangers, comprising:

a plate in which a plurality of through holes is made for positioning of tubes adapted to convey a first heat exchange fluid; said plate having:

an edge;

two main faces each adapted to be contacted by a second heat exchange fluid in a crossing direction from an inlet portion to an outlet portion of said edge of said plate; and said holes being delimited by a respective inner delimiting wall of said plate including a first portion facing towards said inlet portion and a second portion facing towards said outlet portion, said fin comprising at least one confinement unit of said second heat exchange fluid arranged around a hole of said plurality of holes to obtain at least one partially surrounded hole, said at least one confinement unit comprising two baffles arranged one opposite the other with respect to a respective partially surrounded hole as well as each surrounding and spaced from a respective section of said second portion of said delimiting wall of said partially surrounded hole, so as to confine, during use, on said plate a first flow zone of said second heat exchange fluid between each baffle and a respective section of said second portion of said delimiting wall, wherein said baffles comprise a substantially tubular structure so as to delimit at least one first opening.

15. A fin for a finned pack for heat exchangers, comprising:

a plate in which a plurality of through holes is made for positioning of tubes adapted to convey a first heat exchange fluid; said plate having:

an edge;

two main faces each adapted to be contacted by a second heat exchange fluid in a crossing direction from an inlet portion to an outlet portion of said edge of said plate; and said holes being delimited by a respective inner delimiting wall of said plate including a first portion facing towards said inlet portion and a second portion facing towards said outlet portion, said fin comprising at least one confinement unit of said second heat exchange fluid arranged around a hole of said plurality of holes to obtain at least one partially surrounded hole, said at least one confinement unit comprising two through housing recesses each having inserted therein one of two baffles arranged one opposite the other with respect to each respective partially surrounded hole and surrounding and spaced from a respective section of said second portion of said delimiting wall of said partially surrounded hole, so as to confine, during use, on said plate a first flow zone of said second heat exchange fluid between recess and a respective section of said second portion of said delimiting wall, wherein said baffles comprise a structure extended substantially parallel to an axis of symmetry of the respective hole.

16. The fin according to claim 15, wherein said baffles comprise metal sections obtained via extrusion, molding or shaping and then inserted in said housing recesses of said at least one confinement unit.

17. A fin for a finned pack for heat exchangers, comprising:

a plate in which a plurality of through holes is made for positioning of tubes adapted to convey a first heat exchange fluid; said plate having:

an edge;

two main faces each adapted to be contacted by a second heat exchange fluid in a crossing direction from an inlet portion to an outlet portion of said edge of said plate; and said holes being delimited by a respective inner delimiting wall of said plate including a first portion facing towards said inlet portion and a second portion facing towards said outlet portion, said fin comprising at least one confinement unit of said second heat exchange fluid arranged around a hole of said plurality of holes to obtain at least one partially surrounded hole, said at least one confinement unit comprising two baffles arranged one opposite the other with respect to each respective partially surrounded hole and surrounding and spaced from a respective section of said second portion of said delimiting wall of said partially surrounded hole, so as to confine, during use, on said plate a first flow zone of said second heat exchange fluid between each baffle or recess and a respective section of said second portion of said delimiting wall, wherein said baffles comprise a drawn portion of said plate, further comprising at least one first opening defined between said second section and said reinforcement section.

* * * * *